US010273032B2

(12) United States Patent
Dopfer et al.

(10) Patent No.: US 10,273,032 B2
(45) Date of Patent: Apr. 30, 2019

(54) METHOD AND APPARATUS FOR PROCESSING A TRANSPORTATION CONTAINER WITH VALUABLE ARTICLES

(71) Applicant: GIESECKE & DEVRIENT GMBH, München (DE)

(72) Inventors: Peter Dopfer, Geltendorf (DE); Michael Stapfer, Neubiberg (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/316,689

(22) PCT Filed: Jun. 9, 2015

(86) PCT No.: PCT/EP2015/001159
§ 371 (c)(1),
(2) Date: Dec. 6, 2016

(87) PCT Pub. No.: WO2015/188931
PCT Pub. Date: Dec. 17, 2015

(65) Prior Publication Data

US 2017/0158369 A1 Jun. 8, 2017

(30) Foreign Application Priority Data

Jun. 10, 2014 (DE) ..... 10 2014 008 607

(51) Int. Cl.
*B65B 69/00* (2006.01)
*G07D 11/00* (2019.01)

(52) U.S. Cl.
CPC ..... *B65B 69/0033* (2013.01); *B65B 69/0008* (2013.01); *G07D 11/0006* (2013.01)

(58) Field of Classification Search
CPC ..... B65B 69/0008
See application file for complete search history.

(56) References Cited

U.S. PATENT DOCUMENTS 4,696,615 A * 9/1987 Ettischer ..... B65B 69/0033 271/157
4,997,329 A * 3/1991 Hanamoto ..... B08B 9/083 414/412

(Continued)

FOREIGN PATENT DOCUMENTS

DE 3931176 A1 3/1991
DE 102008023128 A1 11/2009
WO 2013050177 A1 4/2013

OTHER PUBLICATIONS

International Preliminary Report on Patentability for corresponding International PCT Application No. PCT/EP2015/001159, dated Dec. 15, 2016.

(Continued)

*Primary Examiner* — Mark C Hageman
(74) *Attorney, Agent, or Firm* — Workman Nydegger

(57) ABSTRACT

A method and an apparatus are provided for processing a transport container with objects of value. The transport container is fed to the apparatus, preferably by means of a transport-container transport device of the apparatus. The apparatus is adapted to process the transport container automatically in accordance with the following steps: In the apparatus, the transport container is severed by means of a severing device, the objects of value are emptied from the severed transport container and are collected by means of a collection container in the apparatus. The collection container with the objects of value is transported away for the further processing of the objects of value by means of a collection-container transport device.

20 Claims, 7 Drawing Sheets

(56) References Cited

U.S. PATENT DOCUMENTS

| | | | | |
|---|---|---|---|---|
| 7,377,423 | B2 * | 5/2008 | Demmeler | G06Q 20/042 235/379 |
| 7,767,925 | B2 * | 8/2010 | DiBiaso | B07C 1/00 209/584 |
| 9,881,439 | B2 * | 1/2018 | Demmeler | B65H 1/027 |
| 2015/0314903 | A1 * | 11/2015 | Aya | B65B 69/0008 414/412 |

OTHER PUBLICATIONS

International Search Report for corresponding International PCT Application No. PCT/EP2015/001159, dated Aug. 4, 2015.

* cited by examiner

METHOD AND APPARATUS FOR PROCESSING A TRANSPORTATION CONTAINER WITH VALUABLE ARTICLES

BACKGROUND

The present invention relates to a method and an apparatus for processing a transport container with objects of value. The objects of value are in particular sheet-shaped value documents, such as banknotes, checks, tickets, etc., and possibly also coins.

As transport containers "safebags" are employed, for example. These are usually configured as completely sealed, bag-shaped disposable containers, preferably made of a plastic foil. In such transport containers objects of value, such as banknotes or other sheet-shaped value documents, but frequently also coins, are transported from a supplier or depositor to a bank or a cash center.

The opening of such a transport container at a receiving unit is currently typically effected manually, for example by means of a pair of scissors or a knife. After the opening of the transport container, the objects of value disposed therein are removed manually. The removed objects of value are then further processed by means of a value-document processing apparatus, for example a banknote processing machine, for example checked with regard to their authenticity, fitness for circulation and/or denomination and/or counted.

A manual processing of such a transport container, in particular a manual opening by means of scissors or a knife, is very time-consuming and therefore expensive. Further, each processing of a transport container with objects of value by a person involves a risk of tampering.

SUMMARY

It is therefore the object of the present invention to suggest a method and an apparatus which take account of the described disadvantages, i.e. which allow an efficient and tamper-proof processing of such transport containers.

The present invention is based on the fundamental idea of no longer carrying out the processing of a transport container with objects of value manually, but of feeding the transport container to a correspondingly adapted apparatus, which is adapted to carry out all processing steps, in particular the opening and emptying of the transport container, and the transporting further of the emptied objects of value for further processing, automatically, i.e. without manual action of an operator of the apparatus, in an efficient manner.

A preferred embodiment of a method for processing the transport containers with objects of value, in particular the above-described "safebags", includes the following steps:

The respective transport container with the objects of value is fed to an apparatus for the automatic processing of the transport container by an operator. A corresponding apparatus will be described in detail below. As already mentioned, all subsequent steps carried out on the transport container and the objects of value emptied therefrom in or by the apparatus are carried out automatically, i.e. without manual action of an operator of the apparatus.

A preferred embodiment of an apparatus for the automatic processing of such a transport container with objects of value includes a transport-container transport device for transporting the transport container into the apparatus and within the apparatus, a severing device for the automatic severing of the transport container within the apparatus, and a control device for controlling the transport-container transport device, the severing device and a collection-container transport device for transporting a collection container provided for collecting objects of value emptied from a severed transport container. The corresponding components of the apparatus are described in detail in the following with reference to the corresponding process steps.

The mentioned feeding of the transport container to the apparatus is generally effected by the transport container being placed on or attached to a transport device by an operator, said transport device transporting the transport container directly or indirectly into the apparatus.

According to a preferred embodiment, this transport device already forms part of the apparatus for the automatic processing of the transport container and corresponds to the mentioned transport-container transport device of the apparatus. Alternatively, it is possible that the transport device does not form part of the apparatus and automatically transfers the transport container to the transport-container transport device of the apparatus. A combination of different conveyor belts is conceivable here.

The transport-container transport device of the apparatus can be configured in various ways. According to a first embodiment, the transport-container transport device is configured as a conveyor belt on which a transport container can be placed for transport into the apparatus and/or within the apparatus.

According to a second embodiment, the transport-container transport device can be configured such that a transport container can be transported substantially suspended therefrom. Such a transport-container transport device can include a preferably horizontally circulating conveyor belt or a preferably horizontally circumferential circulation rail, for example.

The transport-container transport device of the apparatus can include at least one receiving device for receiving or fixing a transport container on or to the transport-container transport device. Such a receiving device can be configured for example as a clamping device for clamping a portion of the transport container. Such a clamping device can be used expediently in connection with a conveyor belt or a suspended attachment to a corresponding transport-container transport device.

Alternatively, the receiving device can also be configured as a suction device for suctioning at least a portion of the transport container to the transport-container transport device. Such an embodiment can advantageously be used in particular in connection with a conveyor belt as the transport-container transport device.

After the transport container has been transported into the apparatus by means of the transport-container transport device, it can be provided that it is checked prior to the severing of the transport container whether the transport container is undamaged.

Such a check can be effected automatically within the apparatus by means of a correspondingly adapted intactness checking device, which is adapted to check the intactness of the transport container. In the case of a transport container made of plastic, this can be effected for example by blowing air into the transport container and deciding on the basis of a subsequent pressure measurement whether the transport container is intact or not.

Alternatively, an intactness check can be effected also by an operator of the apparatus by manually checking the transport container for intactness before feeding the transport container to the apparatus.

In a subsequent step the transport container is severed automatically in the apparatus by means of the severing device of the apparatus. In particular, the transport container is severed such that an opening of the transport container is produced, for example at the bottom of the transport container, so that the objects of value can drop out of the transport container through this opening by force of gravity. The opening produced upon severing preferably extends over the complete width of the transport container. Thus, no objects of value will normally remain in the container.

The severing of the transport container can be effected in various ways. According to a first preferred embodiment the transport container is cut open in a suitable manner for the purpose of severing. The severing device of the apparatus can include a suitably adapted cutting device for this purpose, such as a blade with at least one cutting edge. The pattern, i.e. the guiding of the cutting lines along which the transport container is severed, can depend on the size and/or shape of the transport container and on the material properties of the transport container.

When cutting the transport container open, likewise when using any other fashion of severing the transport container, it must be ensured that a subsequent complete emptying of the transport container is optimally prepared on the one hand. On the other hand, it must be ensured that objects of value disposed in the transport container are not damaged or even destroyed upon severing the transport container.

As an alternative to cutting open the transport container, the transport container can also merely be perforated. For severing the transport container, then portions of the transport container adjacent to a corresponding perforation are moved away from each other by means of the severing device, whereby the transport container is severed along the perforation. In this case the severing device of the apparatus includes a suitable perforating device, for example a perforating wheel, which is adapted to be guided along at least one predetermined perforation line across the transport container.

Finally, the transport container can be thermally treated for severing. A specific action of cold on the transport container, for example by means of a cooling spray, in the case of a plastic container can lead to an embrittlement in the corresponding region which acts similarly to a perforation and can support an opening of the transport container in this manner. Also a thermal action in the form of an action of heat, for example by means of a hot wire, can prepare a severing of the transport container. A transport container in the form of a plastic container can be softened in locally targeted manner by the action of heat, for example, whereby a subsequent severing is prepared. The severing device of the apparatus includes corresponding temperature-action means in connection with these embodiments.

According to a particularly preferred embodiment, the transport container is suctioned prior to the severing by means of a suction device of the apparatus and is then severed in the suctioned region by means of the severing device.

An corresponding suction device typically includes at least one device for generating a negative pressure, i.e. a suction unit, optionally a suction hose connected to the suction unit, as well as a suction head connected to the suction unit via the suction hose, if present. The suction head includes one or several suction openings for suctioning the transport container.

This embodiment can be used advantageously in particular in connection with bag-shaped plastic containers, since the suction device is then adapted to suction at least a portion of a bag wall of the transport container. In the manner described, a corresponding transport containers can be opened quickly and easily. By suctioning the transport container, i.e. in particular a transport container wall of a bag-shaped transport container, by means of the suction device and effecting the severing of the transport container by means of the severing device in the suctioned region, any damage to value documents upon opening can be avoided. In addition, the opening of the transport container is simplified per se. Due to the operating principle of suction and of severing in the suctioned region, any damage to the content of the transport container upon opening is quasi automatically prevented.

According to a particularly preferred variant of this embodiment, the severing device is integrated in a suction head of the suction device. This results in a so-called suction severing head, which optimally supports an opening of a bag-shaped transport container in a safe and variable manner.

It is understood that the severing device of the apparatus for the automatic processing of the transport container can be adjusted to the transport container to be opened. In particular, the severing device can be displaced, for example in dependence on the size and/or shape of the transport container, for example relative to the transport-container transport device. Further, it is possible to displace various components of the severing device, for example various severing means, such as blades or the like, relative to each other in dependence on the size and/or shape of a transport container to be severed. Such an adjustment of the severing device can be effected automatically, for example after the size and shape of a transport container to be severed has been ascertained by a suitable sensor device of the apparatus. Alternatively, such an adjustment can also be effected manually by an operator of the apparatus.

For severing the transport container, the severing device can be displaced relative to the transport container, wherein the transport container temporarily remains stationary during the severing. Alternatively, the severing can be effected by displacing the transport container relative to a stationary severing device. It is also possible that both the transport container and the severing device are not stationary during the severing, but are moved or displaced in a suitable manner.

After severing the transport container, the objects of value disposed in the transport container are automatically emptied from the severed transport container. The emptied objects drop out of the severed transport container by force of gravity and are automatically collected by a collection container in the apparatus.

The emptying of the transport container takes place by means of gravity. In other words, the objects of value drop by force of gravity through the opening created by the severing of the transport container out of the severed transport container into the waiting collection container.

A complete emptying of the transport container can be prepared and/or supported by means of suitable devices of the apparatus, which are hereinafter referred to as emptying-aid devices.

In order to prepare a complete emptying of the transport container, an emptying-aid device can be adapted to so move or displace a transport container arranged at or on the transport-container transport device, prior to the severing of said container, that the objects of value in the transport container are arranged in a predetermined region, for example at the bottom of the transport container. When the transport container is then severed in the region of the bottom, this facilitates the complete emptying of the transport container. Bag-shaped plastic containers transported in suspended fashion can be prepared correspondingly by gentle horizontal vibration, alternating back and forth movement or centrifugal movement about an axis, i.e. the objects of value disposed in the transport container will accumulate predominantly at the bottom of the transport container due to the movement.

Alternatively or additionally, an emptying-aid device can also support the emptying process itself, for example by additionally gently shaking the transport container during emptying. In the case of bag-shaped plastic containers, which have been severed along predetermined cutting lines and are bent open or inverted for emptying, an emptying-aid device can include an ion-spraying apparatus for example. By applying ionized air to the transport container in the region of the exiting objects of value, it can be prevented that sheet-shaped objects of value, such as banknotes, adhere to the transport container through electrostatic charging and are thus not emptied completely. Further, an emptying-aid device can include a pair of suction rollers that can support a complete bending open of a flat transport container severed along for example three main edges.

Preferably, it is automatically checked in the apparatus after emptying the transport container whether there are still any objects of value disposed in the transport container. For this purpose, the apparatus includes a residual-amount checking device which is adapted to check whether there are still objects of value contained in a transport container after emptying.

This check can be carried out in various ways, depending on the type of transport container and/or the type of objects of value transported in the transport container. Particularly in the case of plastic containers and sheet-shaped value documents, such as banknotes, an IR transmission measurement has proven to be an advantageous checking method. In the case that coins are transported in the transport container, a residual-amount checking device can include a metal detector, which can check the presence of coins in the emptied transport container. It is also possible to equip a residual-amount checking device with a camera device and an image recognition device. In this manner, objects of value remaining in the emptied transport container can be detected and recognized optically.

In the event that the transport container has not been emptied completely, i.e. that there are (unintentionally) still objects of value present in the automatically emptied transport container, preferably a corresponding error message is output by the apparatus. The processing of the transport container can be interrupted and the error can be corrected, for example manually, i.e. an operator of the apparatus then empties the transport container completely manually.

Optionally, emptied transport containers can be automatically collected and transported away in the apparatus. This makes it possible to store the temporary transport containers temporarily, in case this is necessary for a subsequent verification of the transport containers, or to recycle or dispose of them. For this purpose the apparatus includes for example a transport-container removal device which is adapted to transport away severed and emptied transport containers. For this purpose for example a conveyor belt or the like can be employed. The apparatus can further include a transport-container gathering device, which is adapted to receive, in particular collect and gather, severed and emptied transport containers.

To be able to carry out a fully automated processing of the transport container, it is advantageous when both the transport container and the collection container can be uniquely identified by the apparatus. For this purpose the transport containers and the collection containers are equipped with a corresponding transport container coding and corresponding collection container coding, for example a bar code or a data carrier readable in contactless fashion, such as a transponder or RFID module.

For uniquely identifying a transport container to be processed, the apparatus preferably includes a reading device. This reading device is adapted to read out a stated transport container coding. The reading device is for example configured in the form of a bar code reading device or a reading device for reading out a contactless data carrier of the type described. From the transport container coding, information concerning the transport container can be derived, for example about the depositor from whom the transport container originates, and possibly also about the objects of value contained in the transport container, for example their total value. This information can be contained in the transport container coding itself or can be retrieved from a database with the aid of the transport container coding, said database containing an allocation of the respective transport container coding to the respective depositor.

The reading device is preferably further adapted to read out a corresponding collection container coding of the collection container. Alternatively, also a separate reading device can be provided in the apparatus for this purpose.

A transport container, the objects of value of which are emptied into a collection container, is uniquely allocated to this individual collection container by the apparatus. The easiest way to effect this is to uniquely allocate an above-mentioned transport container coding to a corresponding collection container coding. In this manner, the origin of the objects of value can be detected automatically which are stored in the collection container that transports further the objects of value for further processing.

The apparatus for the automatic processing of the transport container preferably includes a data communication interface. This data communication interface serves in particular for data communication with further apparatus, for example with a value-document processing apparatus which further processes the value documents contained in the collection container and/or with a system including the apparatus. In the data communication there is for example transmitted the unique transport container coding, linked with the collection container coding uniquely allocated thereto of that collection container by which these objects of value were collected. Alternatively or additionally, the collection container coding can be transmitted also linked with the information about the depositor of the objects of value of the respective transport container. For the data communication conventionally known interfaces and protocols are typically employed.

The collection container with the objects of value emptied from the transport container is finally transported away by means of a corresponding collection-container transport device for the further processing of the objects of value.

This collection-container transport device can form part of the apparatus for processing the transport container on the one hand. Alternatively, the collection-container transport device can form part of a comprehensive system which includes the apparatus for the automatic processing of the transport container.

It is important to ensure that the collection container is transported by the collection-container transport device in such a fashion that the collection container is so arranged at the time of emptying the transport container that the value documents emptied from the transport container can be collected by the collection container. In other words, the collection container must be transported in such a fashion that it is arranged directly below the transport container, for example, at the time of severing and emptying of the transport container. The control of an aforementioned collection-container transport device therefore falls to the control device of the apparatus for processing the transport container, which also controls the transport and the severing of the transport container in the apparatus.

The apparatus for processing the transport container preferably includes a housing which surrounds the substantial components of the apparatus, in particular the severing device and at least parts of the transport-container transporting device.

The housing can include an opening through which objects of value emptied from the transport container can drop into a collection container arranged for example on a collection-container transport device passing below the housing.

Alternatively, the housing can include at least one opening through which a collection-container transport device can transport collection containers into the housing and out of the housing.

Further, the housing typically includes at least one opening through which the transport-container transport device can transport transport containers into the housing. Alternatively, when the transport-container transport device extends substantially completely within the housing, this opening can serve to allow an operator of the device to feed transport containers to the apparatus, i.e. in particular to the transport-container transport device of the apparatus.

A preferred embodiment of a system for processing of objects of value includes an apparatus for the automatic processing of a transport container with objects of value described in detail above. Further, the system includes at least one further value-document processing apparatus, such as a banknote processing apparatus or the like.

The system includes a transport device which is adapted to transport objects of value collected by the collection container to the further value-document processing apparatus. As already mentioned above, such a transport device can simultaneously serve as collection-container transport device in connection with the apparatus for the automatic processing of the transport container.

BRIEF DESCRIPTION OF THE DRAWINGS

The present invention will be described hereinafter by way of example with reference to the attached drawings. The figures are described as follows.

DETAILED DESCRIPTION OF VARIOUS EMBODIMENTS

Figure 1:
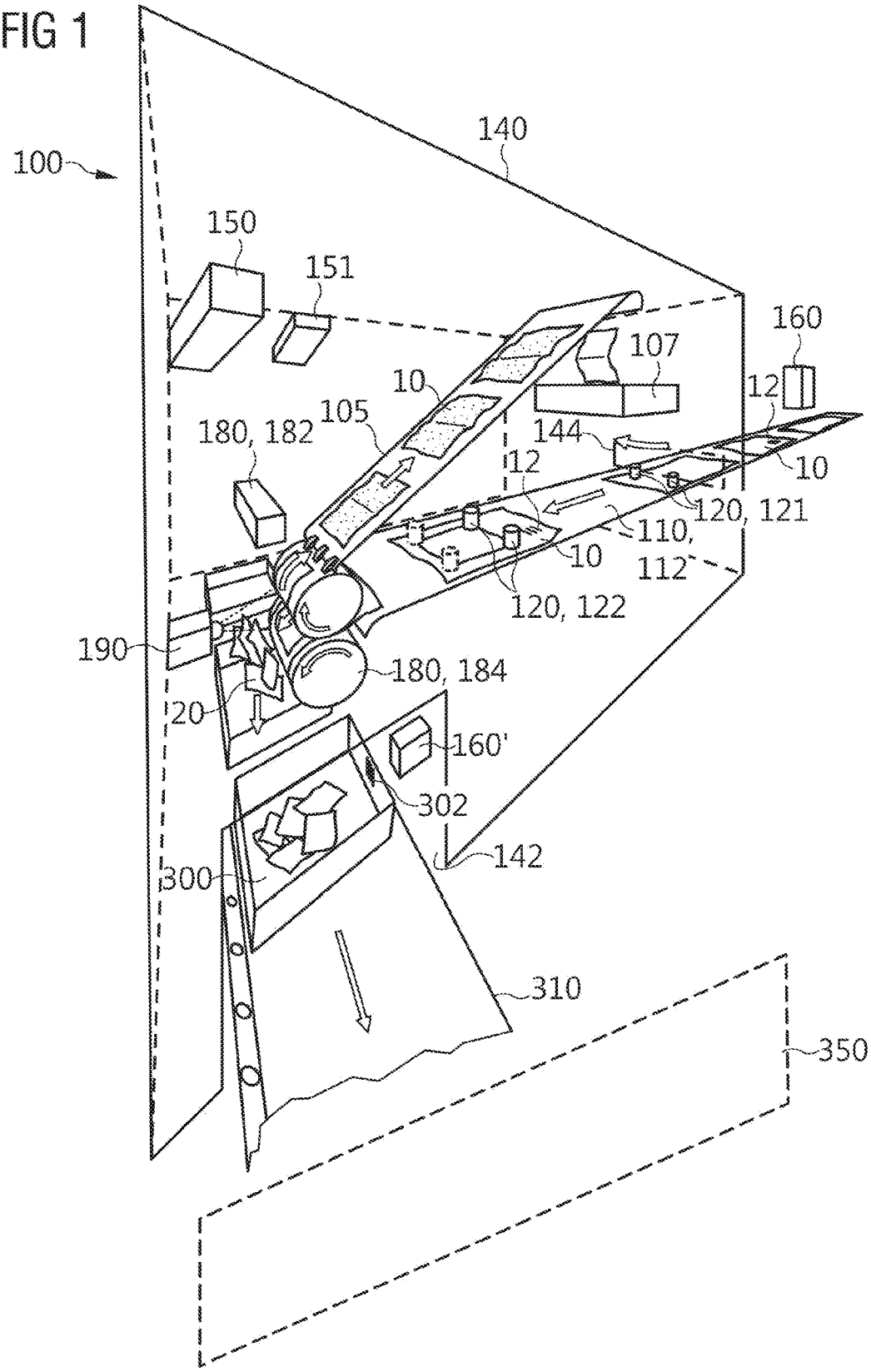
FIG. 1 a first preferred embodiment of an apparatus for the automatic processing of a transport container with objects of value.

In FIG. 1, the apparatus 100 for the automatic processing of transport containers 10 comprising objects of value 20 includes a housing 140 in which typically the substantial components of the apparatus 100 are arranged.

With reference to FIG. 1, as well as with reference to the remaining figures, the transport containers 10 with objects of value 20 are represented as planar, bag-shaped containers 10 comprising objects of value in the form of sheet-shaped objects of value 20, in particular banknotes. Such transport containers 10 are also called "safebags". It is understood that these transport containers 10 can also include coins or other non-sheet-shaped objects of value likewise.

The size and shape of these transport containers 10 can vary. In a plan view of one of the two main surfaces, the transport containers 10 are generally rectangular. Typically, these transport containers 10 are made of plastic foil. The transport containers 10 are usually completely sealed.

They have the size of a large envelope, for example. The thickness is typically limited to a few cm.

Through a first opening 144 of the housing 140 transport containers 10 are introduced in the apparatus 100 via a transport-container transport device 110. For this purpose, an operator of the apparatus 100 can place the transport containers 10 on the conveyor belt 110. The conveyor belt 110 includes a receiving device 112 for securely holding the transport containers 10 on the conveyor belt in the form of a suction device (not shown). This suction device facilitates a subsequently described severing of the transport containers 10, without these slipping off the conveyor belt 110 or being only partially severed, for example.

Still outside of the apparatus 100 a unique transport container coding 12 in the form of a bar code is read out by means of a reading device 160 of the apparatus 100. In this manner, each of the transport containers 10 inserted in the apparatus 100 can be uniquely identified. The reading device 160 is configured as a bar-code reading device in the present example. Alternatively, transponders readable in contactless fashion can for example be applied to the transport containers 10 or introduced in the containers 10, which transponders include corresponding information and can be read out via contactless reading devices for identifying the transport containers 10. The reading device 160 can alternatively also be arranged within the housing 140.

Correspondingly, collection containers 300 provided for collecting objects of value 20 emptied from severed transport containers 10 bear a collection container coding 302 which can also be configured in the form of a bar code. A further reading device 160' within the housing 140 is adapted to read out such a collection container coding 302.

In order to guarantee a fully automatic processing of the transport containers 10 in the apparatus 100, there is typically effected a unique allocation of each transport container 10 to one collection container 300, such that a transport container 10 is uniquely allocated to that collection container 300 which collects the objects of value 20 originally stored in the transport container 10 after the severing and emptying of the transport container 10. The allocation is typically effected on the basis of the read codes 12, 302. In principle, it can be provided that one collection container 300 collects objects of value of several transport containers 10, when they come from the same depositor for example.

A control device 150 may be provided to control the transport-container transport device 110 and a collection-container transport device 310 such that a respective collection container 300 is arranged at the time of emptying of a respective transport container 10 such that the respective collection container 300 collects the objects of value 20 dropping out of the severed transport container. Via a data communication interface 151 of the apparatus 100, corresponding information can be passed on from the apparatus 100 to a further value-document processing apparatus 350 connected to the apparatus 100 or to a system (not shown) including the apparatus 100.

Once arrived in the apparatus 100, the transport containers 10 are severed by means of a severing device 120. In the example shown in FIG. 1, the severing device 120 consists of a movable cutting head 121, which carries out a transversely extending cut on the transport container 10 (the transport device 110 stops briefly for this purpose), and of two stationary cutting heads 122, each of which carries out a longitudinal cut on the transport container 10, so that the transport container 10 is severed substantially along three of its main directions and can be fully bent open for emptying the objects of value 20.

The bending open of the transport container 10 is promoted by an emptying-aid device 180. Said emptying-aid device includes a pair of suction rollers 184 on the one hand, which suction the two container sides and pull them apart. After bending open and pulling apart the two halves of the transport container 10 created by the cuts, the lower one of the two rollers, which was previously still under negative pressure for bending open the transport container, is positively pressurized, the upper one of the two rollers remains under negative pressure and pulls the emptied transport container into the gathering container 107 on the disposal conveyor belt 105. Alternatively, it is also sufficient to turn off the negative pressure on the lower roller or to at least reduce it significantly in comparison to the negative pressure on the upper roller.

The objects of value 20 thereby drop by force of gravity through the opening of the transport container into the collection container 300 arranged below or behind.

In order to prevent individual objects of value 20 from adhering to the emptied transport container 10, the emptying-aid device 180 possibly includes an ion spraying apparatus 182 feeding ionized air to the severed and opened transport container 10, so that the sheet-shaped objects of value 20 drop out of the opened transport container 10 reliably.

A residual-amount checking device 190 in the form of a camera device and a downstream image evaluation device checks whether a transport container 10 has been emptied completely, i.e. whether no object of value 20 remains in the transport container 10 after it has been emptied.

The documents of value 20 collected by the collection container 300 are finally transported away by the collection-container transport device 310 to a further value-document processing apparatus 350, for example, for further processing by a banknote processing machine or the like.

Figure 2:
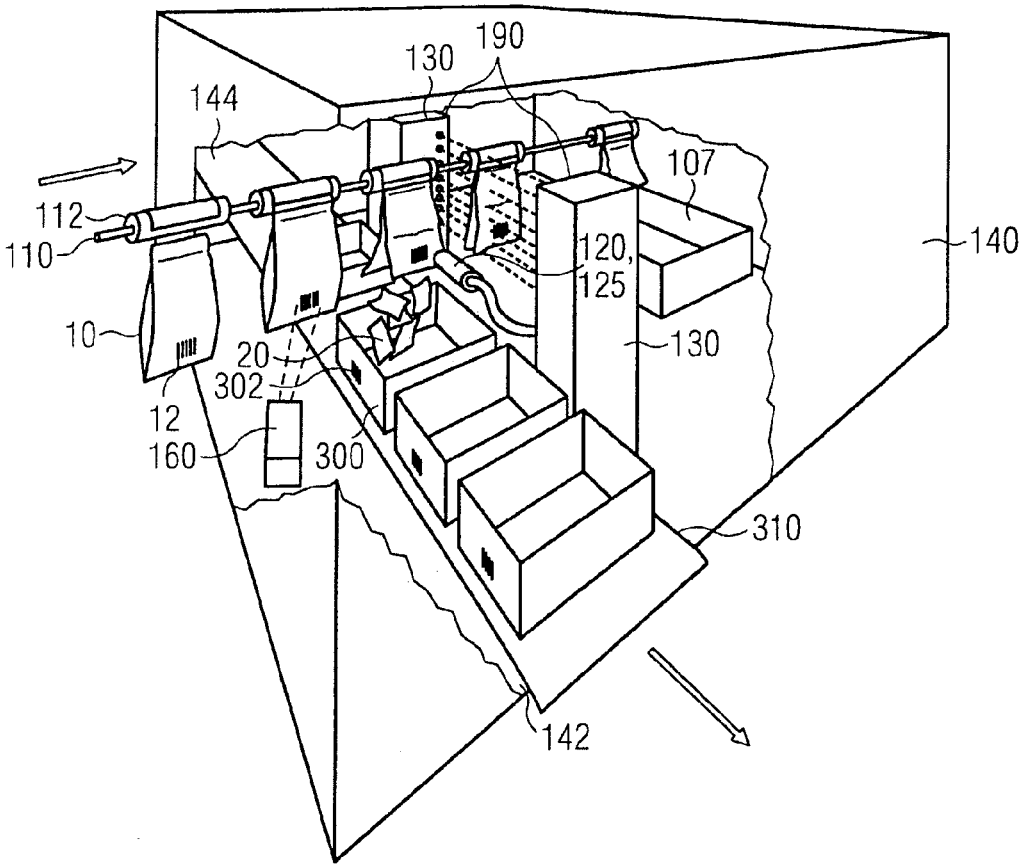
FIG. 2 a second preferred embodiment of such an apparatus.

FIG. 2 shows a second preferred embodiment of an apparatus 100 for the automatic processing of a transport container 10 with objects of value 20. Again, the substantial components of the apparatus 100 are accommodated in a housing 140.

Through a first opening 144 of the housing 140 a transport-container transport device 110 leads into the apparatus. By means of this transport-container transport device 110, which is represented schematically as a conveyor belt with reference to FIG. 2, the transport containers 10, fixed to a receiving device 112 on the transport-container transport device 110 by an operator still outside of the housing 140, are inserted in the apparatus 100.

Figure 3:
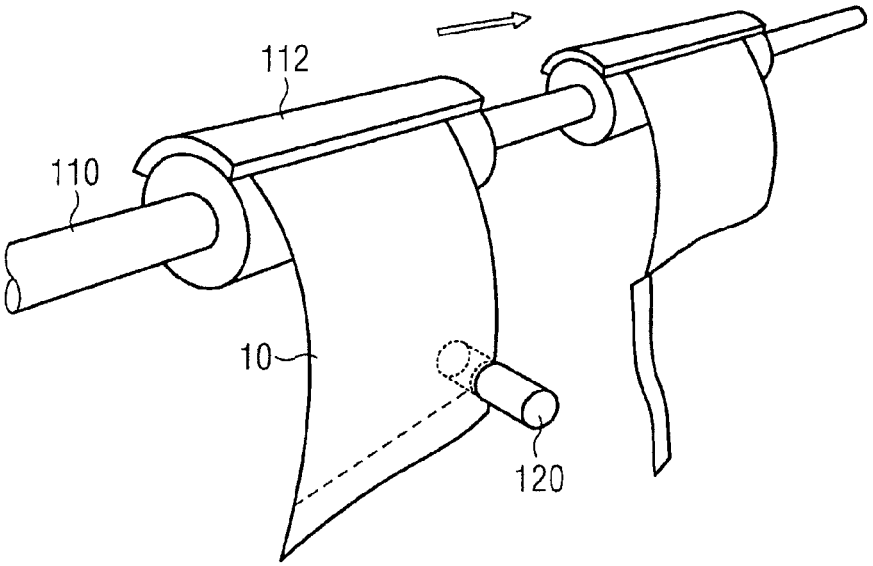
FIG. 3 the mechanism of severing a transport container in the apparatus of FIG. 2.

The receiving device 112 is configured as a clamping device 112 with reference to FIG. 2, which can be seen clearly in FIG. 3. Also with reference to FIG. 2, a transport container coding 12 and a collection container coding 302 are read out by means of a reading device 160 of the apparatus 100, and each transport container 10 is uniquely allocated to that collection container 300 which is provided in each case to collect and transport further the objects of value 20 transported in the transport container 10 after the opening and emptying of the transport container 10.

In the example shown in FIG. 2, the transport containers 10 are also severed automatically by means of a severing device 120, 125 within the apparatus 100, whereby the objects of value 20 drop by force of gravity into the respective collection container 300.

The check whether a transport container 10 has been completely emptied is effected by means of an infrared transmission measurement in the example shown in FIG. 2. A corresponding checking device 190 that includes a transmitting device, a receiving device, possibly an amplifying device and an evaluation device, rays an emptied container 10 and detects objects of value 20 remaining in the transport container 10 in this manner. Emptied transport containers 10 are finally gathered in an gathering container 107 of the apparatus 100.

In FIG. 3, the receiving device 112 of FIG. 2 is shown more clearly, as well as the manner in which the transport container 10 is severed automatically in the apparatus 100. For this purpose, suction severing heads 120 are provided as severing device 120 respectively on the front and back sides of the transport container 10, which are shown in detail in FIGS. 5A and 5B.

Figure 5A:
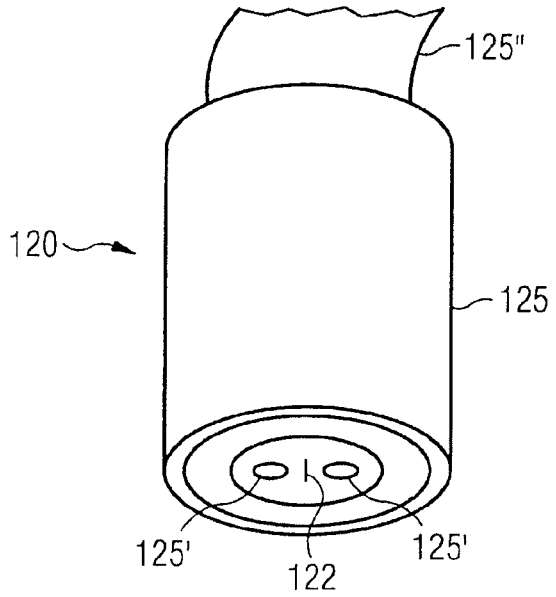
FIGS. 5 A and 5B a preferred embodiment of a severing device for severing a transport container in the apparatus of FIG. 2.
Figure 5B:
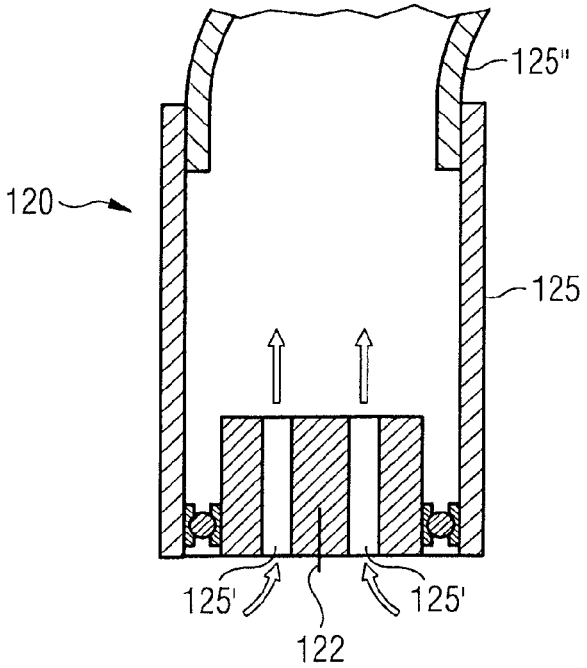

As shown in FIGS. 5A, 5B, a suction head 125, which is connected to a suction unit (not shown) via an indicated suction hose 125", includes suction holes 125' through which air can be suctioned (see arrows in FIG. 5B). In this manner, the suction severing head 120 can suction a surface of the transport container 10 to be opened, in particular a bag wall, when it is brought close enough to a transport container 10 to be opened or when a transport container 10 to be opened is brought close enough to the suction severing head 100 (cf. FIG. 3).

The suction head 125 includes as an integral element a severing means 122 in the form of a blade. This blade 122 serves to sever the transport container 10 in the suctioned region, i.e. to cut it open in the present case.

As shown in FIG. 3, this is accomplished in that the transport container 10 is transported further in the direction of the arrow, while the two opposite, stationary suction severing heads 120 sever the transport container 10 along the severing line indicated. A further transport and safe severing of the transport container 10 can be additionally supported by suitable transport rollers (not shown) which are guided towards the transport container from both sides, for example in the lower region of the transport container 10. A severing is further facilitated by the fact that the blade 122 is rotatably supported in the suction severing head 125, as shown schematically in FIG. 5B. In this way, the blade 122 can be automatically arranged suitably in the cutting direction in each case.

Figure 4A:
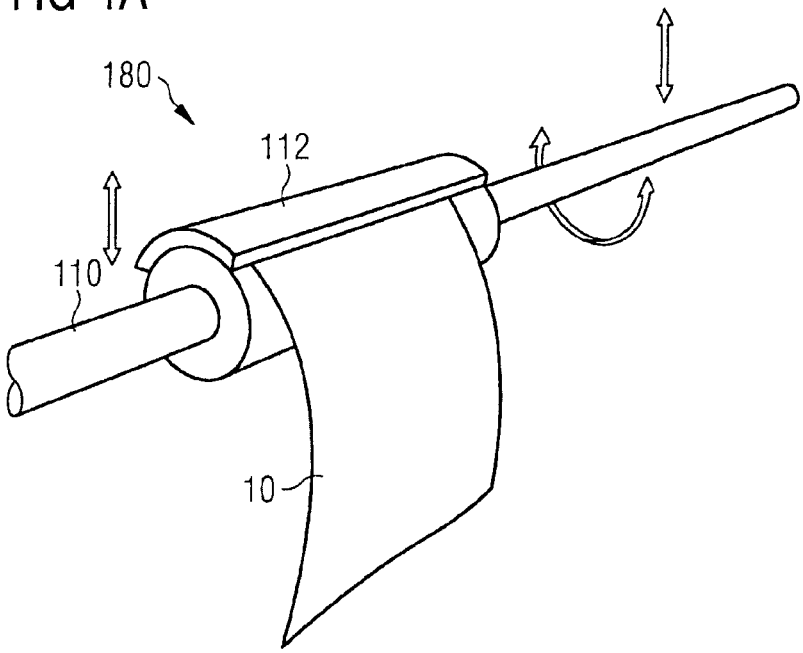
FIGS. 4A, 4B the mode of action of two preferred embodiments of an emptying-aid device in the apparatus of FIG. 2.
Figure 4B:
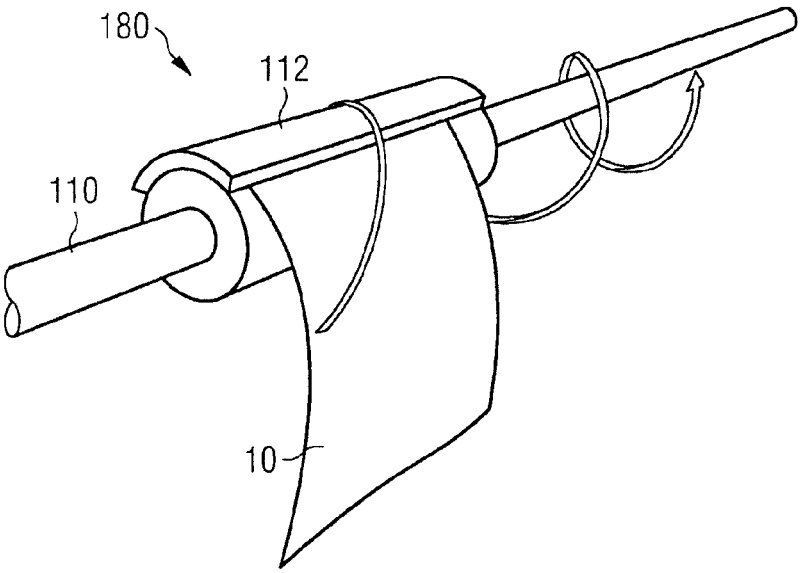

With reference to the FIGS. 4A and 4B, the mode of action of two different emptying-aid devices 180 is shown schematically, which can be used in connection with the apparatus of FIG. 2. The emptying-aid devices 180 are adapted to so move or displace the transport container 10 that the objects of value 20 in the transport container 10 are arranged at the bottom of the transport container.

Thereby the emptying is facilitated when, as shown in FIG. 3, the transport container 10 is severed in the region of the bottom.

A first mode of operation of such an emptying-aid device 180 is shown in FIG. 4A. The transport device 110 can shake the transport container 10 through up and down movement or reciprocal rotational motion, as is indicated by the two arrows in FIG. 4A, which results in the value documents 20 accumulating at the bottom of the transport container 10.

In FIG. 4B an alternative variant of such an emptying-aid device 180 is shown. By a spiraling turning movement, for example by means of a spindle, valuable documents 20 in the transport container 10 can accumulate by action of a centrifugal force at the bottom of the transport container 10.

Figure 6A:
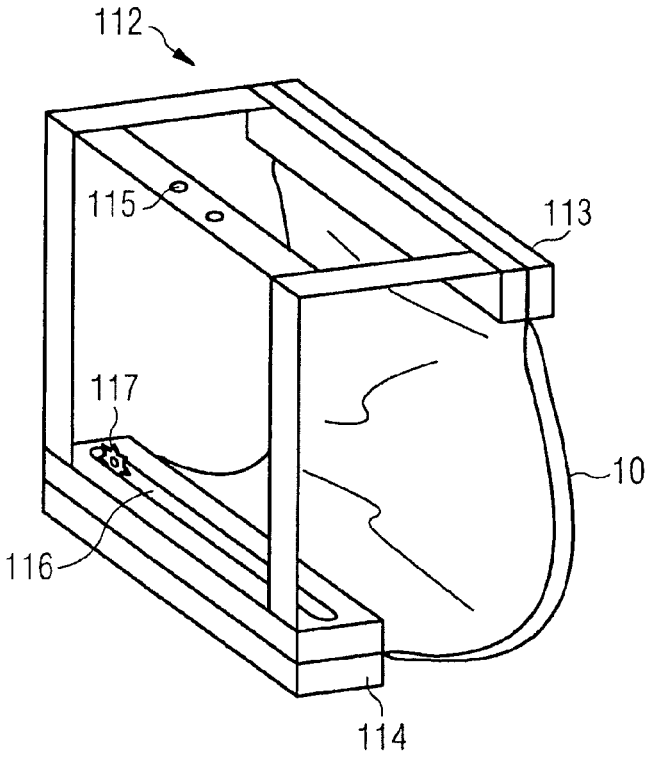
FIG. 6A a receiving device for receiving a transport container on a transport-container transport device in a third preferred embodiment of an apparatus for the automatic processing of a transport container with objects of value.
Figure 6B:
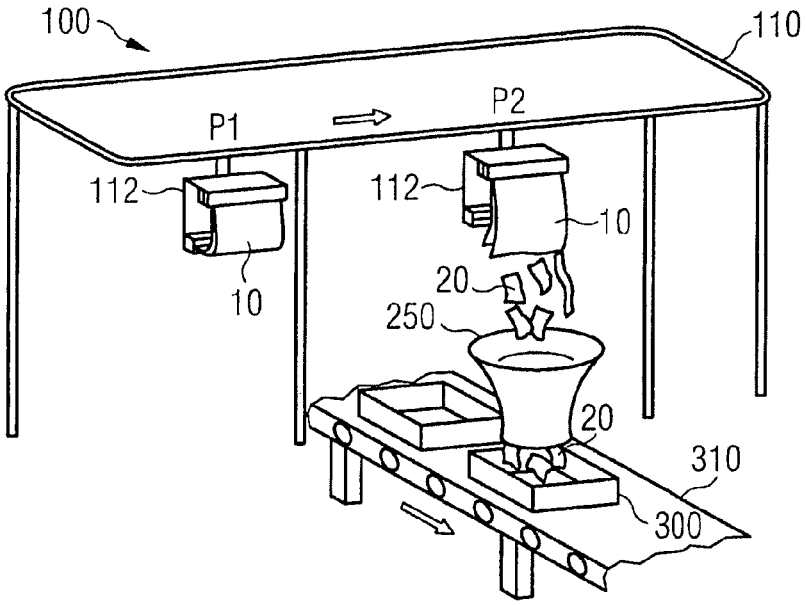
FIG. 6B partially schematically an apparatus according to the third preferred embodiment, and FIG. 7 steps of a preferred embodiment of a method for processing a transport container with objects of value by means of any one of the apparatus of FIG. 1, 2 or 6B.

In the FIGS. 6A and 6B, a third preferred embodiment of an apparatus 100 for the automatic processing of a transport container 10 with objects of value 20 is shown.

FIG. 6A shows a specific receiving device 112 for receiving a transport container 10 in substantially suspended, clamping fashion. The receiving device 112 includes two clamping devices 113, 114, each having two movable jaws. By means of these clamping devices, an operator of the apparatus can clamp the transport container 10 between the two movable jaws in each case. In the clamping device 113, the transport container 10 hangs vertically downwards. The clamping device 114 arranged below is arranged perpendicularly thereto. Alternatively, the clamping device could also be arranged merely at an angle, i.e. not necessarily exactly perpendicularly, or only horizontally spaced apart from the clamping device 113. When the clamping device 114 is opened (see FIG. 6B, position P2) and the transport container 10 has been severed in the region that is still clamped in the clamping device 114 in FIG. 6A, this region of the transport container 10 sags downward by force of gravity, i.e. the transport container remains suspended only in the clamping device 113, and the objects of value 20 stored in the transport container 10 drop out of the transport container 10 likewise by force of gravity. The clamping device 114 includes a gap 116 in the upper jaw, in which a severing device 117, for example a perforating wheel or a blade, can be guided to sever the transport container 10.

In FIG. 6B an apparatus 100 according to the third embodiment is shown, without a surrounding housing and without the various reading and checking devices, which have already been described in detail with reference to FIGS. 1 and 2. It is understood that the embodiment according to FIG. 6B can include such reading and checking devices as well.

The apparatus 100 according to the third embodiment includes a transport-container transport device 110 in the form of a horizontally circumferential conveyor rail. On this conveyor rail several of the receiving devices 112 shown in FIG. 6A are suspended movably. In a first position P1 a receiving device 112 is shown with an engaged, still closed transport container 10. The transport-container transport device 110 can extend entirely within the (not shown) housing.

After transport (along the direction of the arrow), the transport container 10 is then automatically severed in the apparatus 110 in the position P2, and the objects of value 20 drop by force of gravity into a collection container 300 arranged below the transport container 10. The severing of the transport container 10 is effected here by an automatic actuation of the severing device 110 in the form of the severing means 117 (see FIG. 6A).

To ensure that all objects of value 20 emptied from the transport container actually fall into the collection container 300, rather than next to it, a collecting-aid device 250 can be provided, for example in the form of a funnel or the like. It is understood that such a collecting-aid device 250 can be used in connection with any desired embodiment of an apparatus 100, in particular also in the embodiments of FIG. 1 or FIG. 2.

Figure 7:
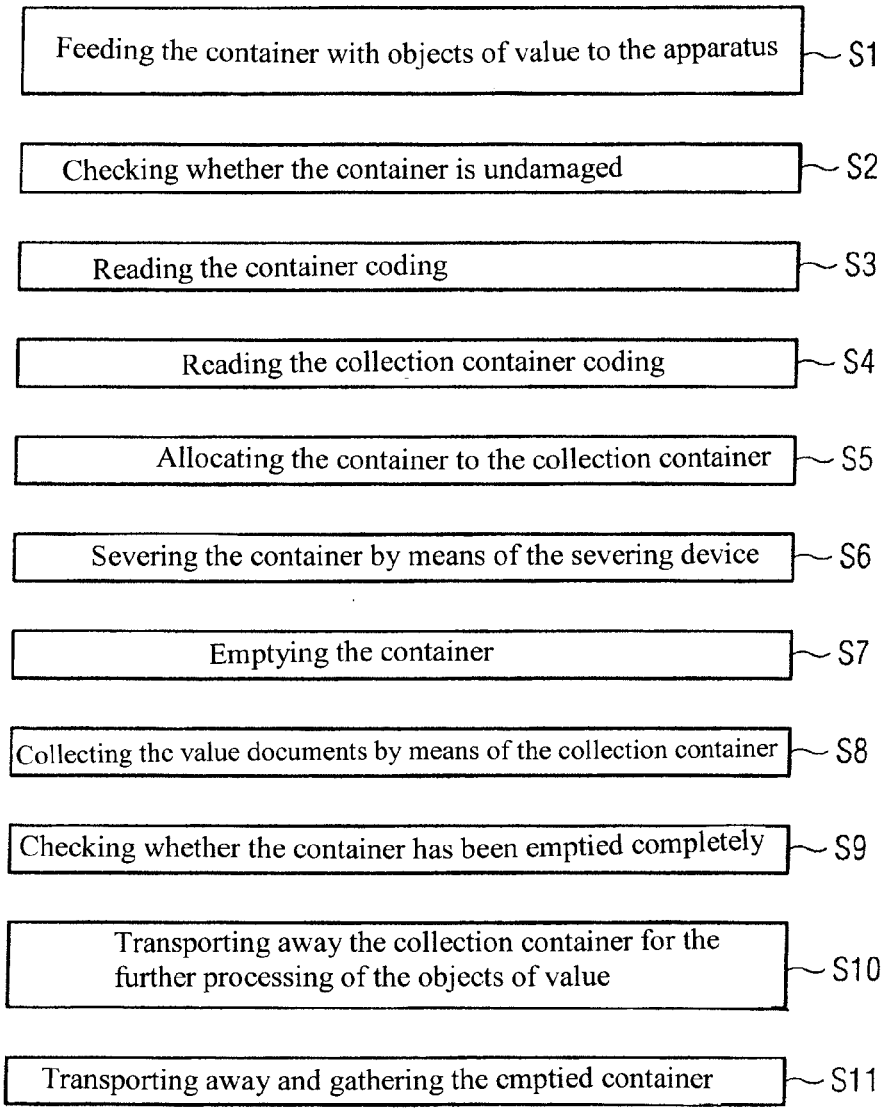

In the following, steps of a preferred embodiment of a method for processing a transport container 10 with objects of value 20 will be described again in summary with reference to FIG. 7.

In a first step S1 a transport container 10 with objects of value 20 is fed to an apparatus 100 for the automatic processing of such a transport container.

In step S2 it is checked whether the transport container 10 is undamaged. The apparatus 100 can include a corresponding intactness-checking device for this purpose. Alternatively, an operator of the apparatus 100 can also check whether the transport container 10 is intact before feeding the transport container 10 to the apparatus 100.

In step S3 a transport container coding 12 is read to identify the transport container 10 uniquely.

Correspondingly, in step S4 a collection container coding 302 of a collection container 300 is read, said collection container being provided for collecting the documents of value 20 disposed in the transport container 10 after opening and emptying the transport container 10.

In step S5 an allocation of the transport container 10 to the collection container 300 is effected. Preferably, this allocation is effected on the basis of the codings 12, 302 read out in the steps S3 and S4. In step S6 the transport container 10 is severed automatically by means of a severing device 120 of the apparatus 100.

Subsequently, the transport container 10 is emptied in step S7. Typically, this is effected substantially by force of gravity.

In step S8, the objects of value 20 emptied from the transport container 10 are collected by means of the collection container 300.

In step S9 it is checked whether the transport container 10 has been emptied completely. The apparatus 100 includes a suitably adapted residual-amount checking device for this purpose.

A transporting away of the collection container 300 with the value documents 20 for the further processing of the same is effected in step S10.

In step S11 a transporting away and gathering of the emptied transport container within the apparatus 100 can be effected.

Preferred embodiments of the present invention are summarized in the following paragraphs:

1. A method for processing a transport container with objects of value, in particular documents of value such as banknotes, comprising the steps of:

feeding the transport container to an apparatus for the automatic processing of the transport container;

automatic severing of the transport container in the apparatus by means of a severing device;

automatic emptying of the objects of value from the severed transport container;

automatic collection of the emptied objects of value by a collection container in the apparatus;

automatic transporting away of the collection container with the objects of value for the further processing of the objects of value.

2. The method according to paragraph 1, characterized in that the transport container is fed to the apparatus by the transport container being placed on or attached to a transport device which transports the transport container directly or indirectly into the apparatus.

3. The method according to paragraph 2, characterized in that the transport device forms part of the apparatus.

4. The method according to paragraph 2, characterized in that the transport device does not form part of the apparatus and transfers the transport container to a transport device of the apparatus.

5. The method according to any of the paragraphs 1 to 4, characterized in that it is checked prior to the severing of the transport container whether the transport container is undamaged.

6. The method according to any of the paragraphs 1 to 5, characterized in that the step of severing the transport container includes a step of cutting open the transport container.

7. The method according to any of the paragraphs 1 to 5, characterized in that the step of severing the transport container includes a step of perforating the transport container.

8. The method according to any of the paragraphs 1 to 5, characterized in that the step of severing the transport container includes a step of thermally treating the transport container.

9. The method according to any of the paragraphs 1 to 8, characterized in that the transport container is suctioned by means of a suction device prior to the severing and is then severed in the suctioned region by means of the severing device.

10. The method according to any of the paragraphs 1 to 9, characterized in that for severing the transport container, the severing device is displaced relative to the transport container, wherein the transport container remains stationary.

11. The method according to any of the paragraphs 1 to 9, characterized in that for severing the transport container, the transport container is displaced relative to the severing device, wherein the severing device remains stationary.

12. The method according to any of the paragraphs 1 to 11, characterized in that the severing device in the apparatus is adjusted to the size and/or the shape of the transport container prior to the severing of the transport container.

13. The method according to any of the paragraphs 1 to 12, characterized in that the emptying of the transport container is effected by force of gravity.

14. The method according to any of the paragraphs 1 to 13, characterized in that the transport container is shaken during the emptying.

15. The method according to any of the paragraphs 1 to 14, characterized in that ionized air is applied to the transport container during the emptying.

16. The method according to any of the paragraphs 1 to 15, characterized in that the transport container is displaced or moved for supporting the emptying prior to the severing, in order to effectuate an arrangement of the objects of value in a predetermined region of the transport container.

17. The method according to any of the paragraphs 1 to 16, characterized in that the transport container is identified.

18. The method according to paragraph 17, characterized in that the transport container is identified by reading out a transport container coding of the transport container.

19. The method according to any of the paragraphs 1 to 18, characterized in that the collection container is identified.

20. The method according to paragraph 19, characterized in that the collection container is identified by reading out a collection container coding of the collection container.

21. The method according to any of the paragraphs 1 to 20, characterized in that the transport container is allocated to exactly that individual collection container which collects the objects of value emptied from the transport container.

22. The method according to any of the paragraphs 1 to 21, characterized in that the collection container is transported in such a fashion that the collection container is so arranged at the time of emptying the transport container that the objects of value emptied from the transport container can be collected by the collection container.

23. The method according to any of the paragraphs 1 to 22, characterized in that after the emptying of the transport container it is checked whether there are still any objects of value disposed in the transport container.

24. The method according to paragraph 23, characterized in that the check whether there are still any objects of value disposed in the transport container is carried out by means of an IR transmission measurement.

25. The method according to paragraph 23 or 24, characterized in that the check whether coins are still disposed in the transport container is carried out by means of a metal detector.

26. The method according to any of the paragraphs 1 to 25, characterized in that an emptied transport container is transported away and collected.

27. An apparatus for the automatic processing of a transport container with objects of value, in particular value documents such as banknotes, comprising:

a transport-container transport device for transporting the transport container;

a severing device for severing the transport container and a control device for controlling the transport-container transport device, the severing device and a collection-container transport device for transporting a collection container for collecting objects of value emptied from the severed transport container.

28. The apparatus according to paragraph 27, characterized by a housing in which the severing device and at least parts of the transport-container transport device are arranged.

29. The apparatus according to paragraph 27 or 28, characterized in that the transport-container transport device is configured as a conveyor belt, on which a transport container can be placed for transport.

30. The apparatus according to paragraph 27 or 28, characterized in that the transport-container transport device is configured such that a transport container can be transported suspended therefrom.

31. The apparatus according to paragraph 30, characterized in that the transport-container transport device includes a conveyor belt or a conveyor rail or a conveyor rod.

32. The apparatus according to any of the paragraphs 27 to 31, characterized in that the transport-container transport device includes at least one receiving device for receiving or fixing a transport container on or to the transport-container transport device.

33. The apparatus according to paragraph 32, characterized in that the receiving device is configured as a clamping device for clamping the transport container.

34. The apparatus according to paragraph 32, characterized in that the receiving device is configured as a suction device for suctioning the transport container to the transport-container transport device.

35. The apparatus according to any of the paragraphs 27 to 34, characterized in that the severing device includes a cutting device.

36. The apparatus according to any of the paragraphs 27 to 34, characterized in that the severing device includes a perforating device.

37. The apparatus according to any of the paragraphs 27 to 36, characterized in that the apparatus includes a suction device which is adapted to suction a transport container, and that the severing device is adapted to sever the transport container in the suctioned region.

38. The apparatus according to paragraph 37, characterized in that the severing device is integrated in a suction head of the suction device.

39. The apparatus according to any of the paragraphs 27 to 38, characterized in that the apparatus includes a data communication interface for data communication.

40. The apparatus according to any of the paragraphs 27 to 39, characterized in that the apparatus includes at least one reading device which is adapted to read out a transport container coding and/or a collection container coding.

41. The apparatus according to paragraph 40, characterized in that the at least one reading device is configured as a bar-code reading device or as a contactless reading device for reading a data carrier communicating in contactless fashion.

42. The apparatus according to any of the paragraphs 27 to 41, characterized in that the apparatus includes an intactness checking device which is adapted to check the intactness of a transport container.

43. The apparatus according to any of the paragraphs 27 to 42, characterized in that the apparatus includes an emptying-aid device which is adapted to support an emptying of a severed transport container.

44. The apparatus according to paragraph 43, characterized in that the emptying-aid device includes an ion spraying apparatus.

45. The apparatus according to paragraph 43 or 44, characterized in that the emptying-aid device includes a pair of suction rollers for bending open a severed transport container.

46. The apparatus according to any of the paragraphs 43 to 45, characterized in that the emptying-aid device is adapted to so move or displace the transport container that the objects of value in the transport container are arranged in a predetermined region.

47. The apparatus according to any of the paragraphs 27 to 46, characterized in that the apparatus includes a residual-amount checking device which is adapted to check whether objects of value are contained in a transport container.

48. The apparatus according to paragraph 47, characterized in that the residual-amount checking device is adapted to carry out an IR transmission measurement on the transport container.

49. The apparatus according to paragraph 47, characterized in that the residual-amount checking device includes a metal detector.

50. The apparatus according to paragraph 47, characterized in that the residual-amount checking device includes a camera device and an image recognition device.

51. The apparatus according to any of the paragraphs 27 to 50, characterized in that the apparatus includes a transport-container removal device which is adapted to transport away severed and emptied transport containers.

52. The apparatus according to any of the paragraphs 27 to 51, characterized in that the apparatus includes a transport-container gathering device which is adapted to receive severed and emptied transport containers.

53. The apparatus according to any of the paragraphs 27 to 52, characterized in that the apparatus includes a collection-container transport device for transporting a collection container for collecting objects of value emptied from the severed transport container.

54. The apparatus according to any of the paragraphs 28 to 53, characterized in that the housing includes an opening through which objects of value emptied from a transport container can drop into a collection container arranged below the housing.

55. The apparatus according to any of the paragraphs 28 to 53, characterized in that the housing includes at least one opening through which a collection-container transport device can transport collection containers into the housing and/or out of the housing.

56. The apparatus according to any of the paragraphs 28 to 55, characterized in that the housing includes at least one opening through which the transport-container transport device can transport the transport containers into the housing, or an opening through which an operator can feed the transport container to the apparatus.

57. A system for processing of objects of value, in particular value documents such as banknotes, comprising an apparatus according to any of the paragraphs 27 to 56, and at least one further value-document processing apparatus.

58. The system according to paragraph 57, characterized in that the system includes a transport device which is adapted to transport objects of value collected by the collection container to the further value-document processing apparatus.

59. The system according to paragraph 58, characterized in that the transport device is adapted to operate in addition as collection-container transport device for transporting a collection container in the apparatus according to any of the paragraphs 27 to 54.

60. The system according to any of the paragraphs 57 to 60, characterized in that the further value-document processing apparatus is configured as a banknote processing apparatus.

The invention claimed is:

1. A method for processing a transport container containing objects of value, the method comprising the steps of:

feeding the transport container to an apparatus for the automatic processing of the transport container by a transport-container transport device;

transporting a collection container by a collection-container transport device;

automatically severing the transport container in the apparatus by a severing device in order to automatically empty the objects of value from the severed transport container into the collection container;

controlling the collection-container transport device by a control device in such a fashion that the collection container is arranged directly below the respective transport container at the time of emptying of the severed transport container;

automatically collecting the emptied objects of value by the collection container collecting the objects of value dropping out of the severed transport container; and automatically transporting away the collection container with the objects of value by the collection-container transport device for further processing of the objects of value.

2. The method according to claim 1, wherein the transport container is fed to the apparatus by the transport container being placed on or attached to the transport-container transport device which transports the transport container directly or indirectly into the apparatus.

3. The method of claim 1, wherein the transport container is suctioned by a suction device prior to the severing and is then severed in the suctioned region by the severing device.

4. The method according to claim 1, wherein the automatic emptying of the transport container is effected in that the objects of value drop out of the severed transport container by force of gravity.

5. The method according to claim 1, wherein the transport container has a unique transport-container coding and the collection container has a unique collection container coding, and the transport container is identified by its transport container coding and the collection container is identified by its collection container coding.

6. The method according to claim 5, wherein the respective transport container, the objects of value of which are emptied into a collection container, is uniquely allocated to said collection container, in that the transport container coding of the respective transport container is uniquely allocated to the collection container coding of the respective collection container.

7. The method according to claim 1, wherein the collection container is transported in such a fashion that the collecting container is so arranged at the time of emptying the transport container that the objects of value dropping out of the severed transport container are collected by the collection container.

8. The method according to claim 1, wherein after the emptying of the transport container it is automatically checked whether there are objects of value still disposed in the transport container, and if this is the case a corresponding error message is output automatically.

9. An apparatus for automatic processing of a transport container containing objects of value, the apparatus including:

a transport-container transport device for transporting the transport container;

a collection-container transport device for transporting a collection container;

a severing device for severing the transport container such that the objects of value of the respective transport container are automatically emptied into the collection container; and a control device that controls the transport-container transport device and the collection-container transport device wherein the transport-container transport device and the collection-container transport device are controlled by the control device such that the respective collection container is arranged directly below the respective transport container at the time of emptying of the respective transport container such that the respective collection container collects the objects of value dropping out of the severed transport container.

10. The apparatus according to claim 9, wherein the transport-container transport device includes at least one receiving device for receiving or fixing a transport container on or to the transport-container transport device.

11. The apparatus according to claim 9, wherein the apparatus includes a suction device adapted to suction a transport container, and that the severing device is adapted to sever the transport container in the suctioned region.

12. The apparatus according to claim 9, wherein the apparatus includes a reading device adapted to read out a unique transport container coding of the transport container, and a second reading device adapted to read out a unique collection container coding of the collection container.

13. The apparatus according to claim 12, wherein the apparatus includes a data communication interface for data communication, via which the unique transport container coding and/or information about the depositor of the objects of value of the respective transport container are transmitted in a fashion linked with the collection container coding of that collection container by which the respective objects of value of the respective transport container were collected.

14. The apparatus according to claim 9, wherein the apparatus includes a residual-amount checking device adapted to check whether there are objects of value still disposed in the transport container after its emptying.

15. A system for processing of objects of value, comprising an apparatus according to claim 9 and at least one further value-document processing apparatus.

16. The apparatus according to claim 9, wherein the transport container has a unique transport-container coding and the collection container has a unique collection container coding, and the transport container is identified by its transport container coding and the collection container is identified by its collection container coding.

17. The apparatus according to claim 16, wherein the respective transport container, the objects of value of which are emptied into the respective collection container, is uniquely allocated to said collection container in that the transport container coding of the respective transport container is uniquely allocated to the collection container coding of the respective collection container.

18. The apparatus according to claim 9, wherein after the emptying of the transport container, the apparatus automatically checks whether there are objects of value still disposed in the transport container, and if there are objects of value still disposed in the transport container a corresponding error message is output automatically.

19. The apparatus according to claim 9, wherein the control device is adapted to control the severing device such that the severing device is adjusted to the transport container to be opened in dependence on the size and/or shape of the transport container.

20. The apparatus according to claim 9, wherein the collection-container transport device is adapted to transport the collection container away with the objects of value for further processing of the objects of value.

* * * * *